US006945142B1

(12) United States Patent
Chen

(10) Patent No.: US 6,945,142 B1
(45) Date of Patent: Sep. 20, 2005

(54) SOCKET

(76) Inventor: Yu Tang Chen, No. 1, Alley 16, Lane 40, Jinn Te Rd., Taichung (TW)

( * ) Notice: Subject to any disclaimer, the term of this patent is extended or adjusted under 35 U.S.C. 154(b) by 27 days.

(21) Appl. No.: 10/694,305

(22) Filed: Oct. 23, 2003

(51) Int. Cl.[7] ..... B25B 13/00
(52) U.S. Cl. ..... 81/124.3
(58) Field of Search ..... 81/124.3, 177.85, 81/121.1, 124.6

(56) References Cited

U.S. PATENT DOCUMENTS 3,908,489 A * 9/1975 Yamamoto et al. ..... 81/124.3
4,817,475 A * 4/1989 Kelly et al. ..... 81/121.1
5,279,190 A * 1/1994 Goss et al. ..... 81/460
5,295,422 A * 3/1994 Chow ..... 81/124.3
5,647,252 A * 7/1997 Miner ..... 81/62
6,282,994 B1 * 9/2001 Wei ..... 81/121.1
2003/0126960 A1 * 7/2003 Alex

* cited by examiner

*Primary Examiner*—Jacob K. Ackun, Jr.

(57) ABSTRACT

A socket includes a socket body having a periphery formed with a plurality of insertion recesses each having two opposite sides each formed with a first urging face and has a mediate portion formed with a second urging face located between the first urging faces of the two opposite sides, so that the socket body of the socket has a greater structural strength, thereby preventing the socket from being broken or worn out due to an excessive torque during operation of the socket.

10 Claims, 21 Drawing Sheets

SOCKET

BACKGROUND OF THE INVENTION

1. Field of the Invention

The present invention relates to a socket, and more particularly to a socket that can be operated broadly and diversely and has a greater structural strength, thereby preventing the socket from being broken or worn out due to an excessive torque during operation of the socket.

2. Description of the Related Art

A conventional socket comprises a socket body having a first end formed with a square hole for mounting a square stud of a ratchet wrench and a second end formed with a hexagonal recess for mounting a workpiece, such as a nut or the like. Thus, the socket co-operates with the ratchet wrench to rotate the workpiece. However, the inner wall of the socket body of the socket has a smaller structural strength, so that the socket is easily broken or worn out due to an excessive torque during operation of the socket.

SUMMARY OF THE INVENTION

The primary objective of the present invention is to provide a socket that can be operated broadly and diversely.

Another objective of the present invention is to provide a socket, wherein each of the insertion recesses of the socket body of the socket has two opposite sides each formed with a first urging face and a mediate portion formed with a second urging face located between the first urging faces, so that the socket body of the socket has a greater structural strength, thereby preventing the socket from being broken or worn out due to an excessive torque during operation of the socket.

In accordance with the present invention, there is provided a socket, comprising a socket body having a periphery formed with a plurality of insertion recesses each having two opposite sides each formed with a first urging face and has a mediate portion formed with a second urging face located between the first urging faces of the two opposite sides.

Further benefits and advantages of the present invention will become apparent after a careful reading of the detailed description with appropriate reference to the accompanying drawings.

DETAILED DESCRIPTION OF THE INVENTION

Figure 1:
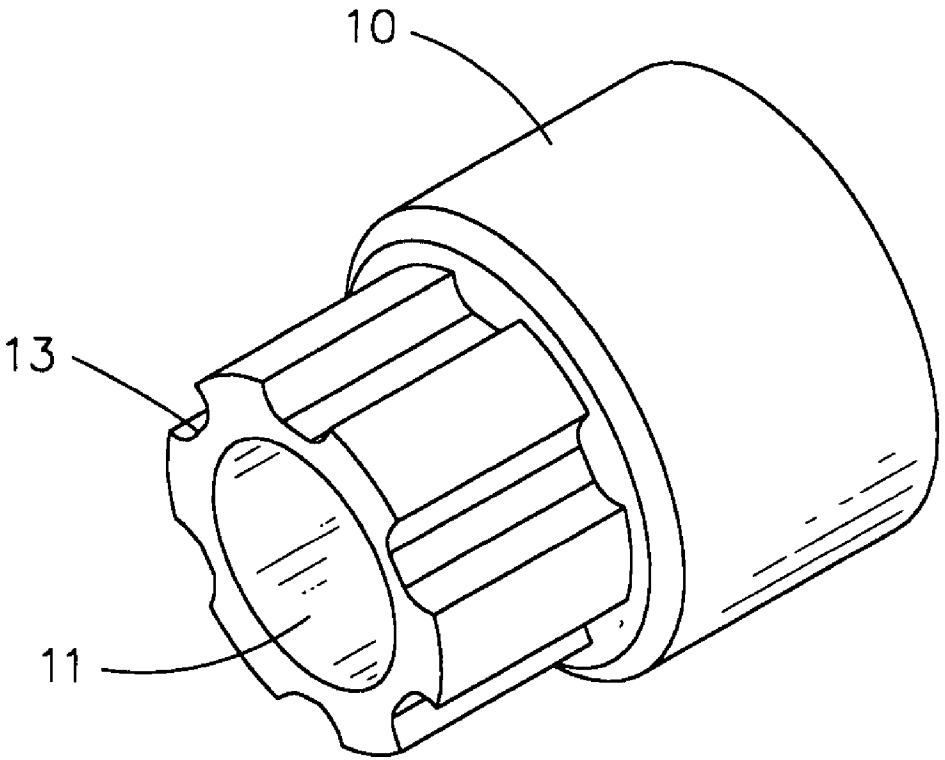
FIG. 1 is a perspective view of a socket in accordance with the preferred embodiment of the present invention.
Figure 2:
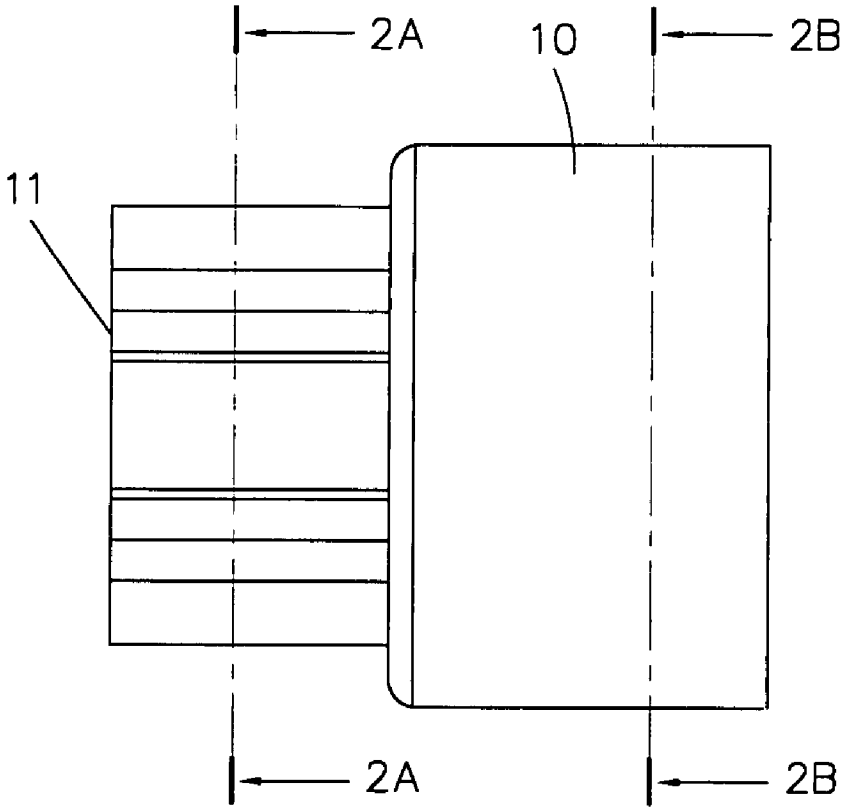
FIG. 2 is a plan view of the socket as shown in FIG. 1.
Figure 2A:
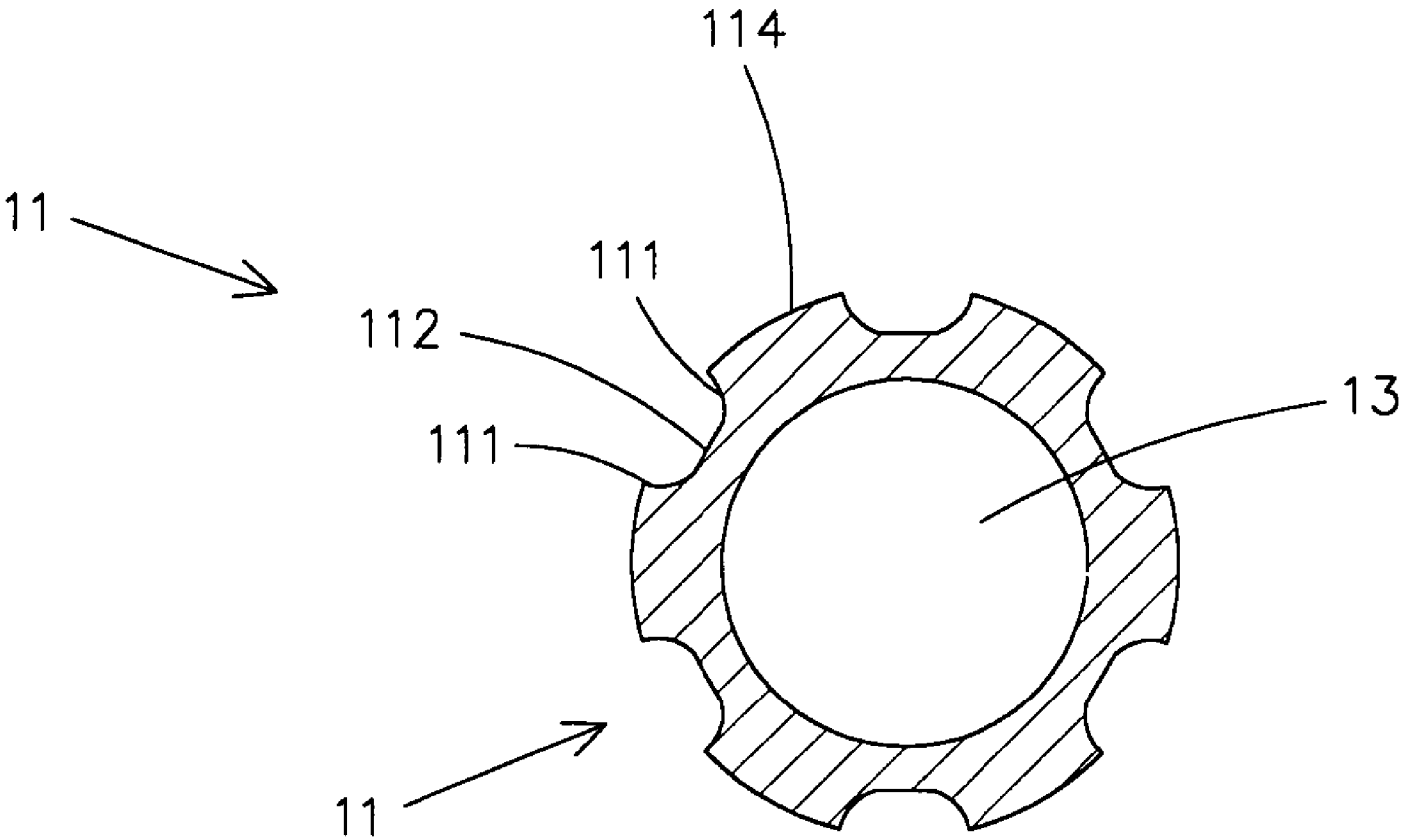
FIG. 2A is a plan cross-sectional view of the socket taken along line 2A—2A as shown in FIG. 2.
Figure 2B:
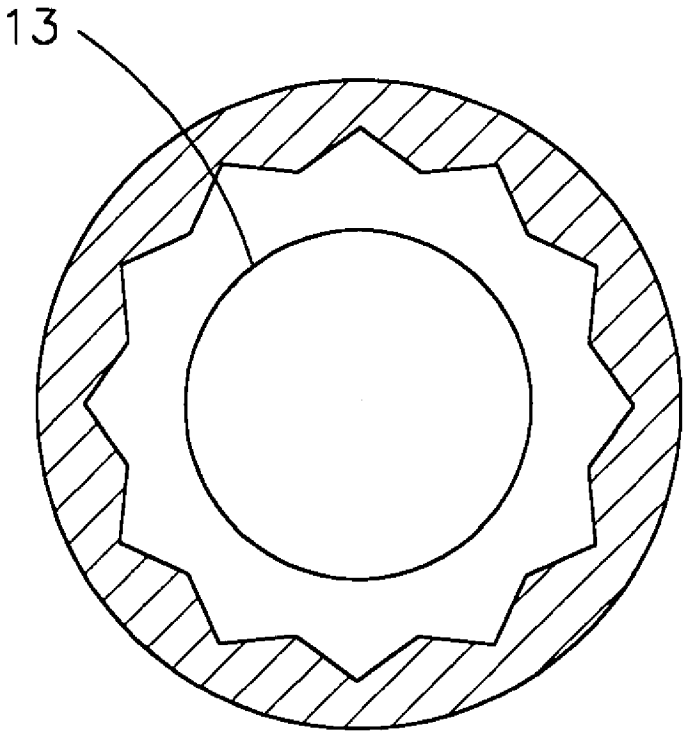
FIG. 2B is a plan cross-sectional view of the socket taken along line 2B—2B as shown in FIG. 2.

Referring to the drawings and initially to FIGS. 1, 2, 2A and 2B, a socket in accordance with the preferred embodiment of the present invention comprises a socket body 10 having a periphery formed with a plurality of insertion recesses 11 and a plurality of arc-shaped protruding faces 114 located between the insertion recesses 11. The socket body 10 has an inside formed with a circular mounting hole 13. Each of the insertion recesses 11 has two opposite sides each formed with a first urging face 111 and has a mediate portion formed with a second urging face 112 located between the first urging faces 111. Preferably, the first urging face 111 of each of the insertion recesses 11 has a concave arc-shape, and the second urging face 112 of each of the insertion recesses 11 has a flat shape.

Figure 3:
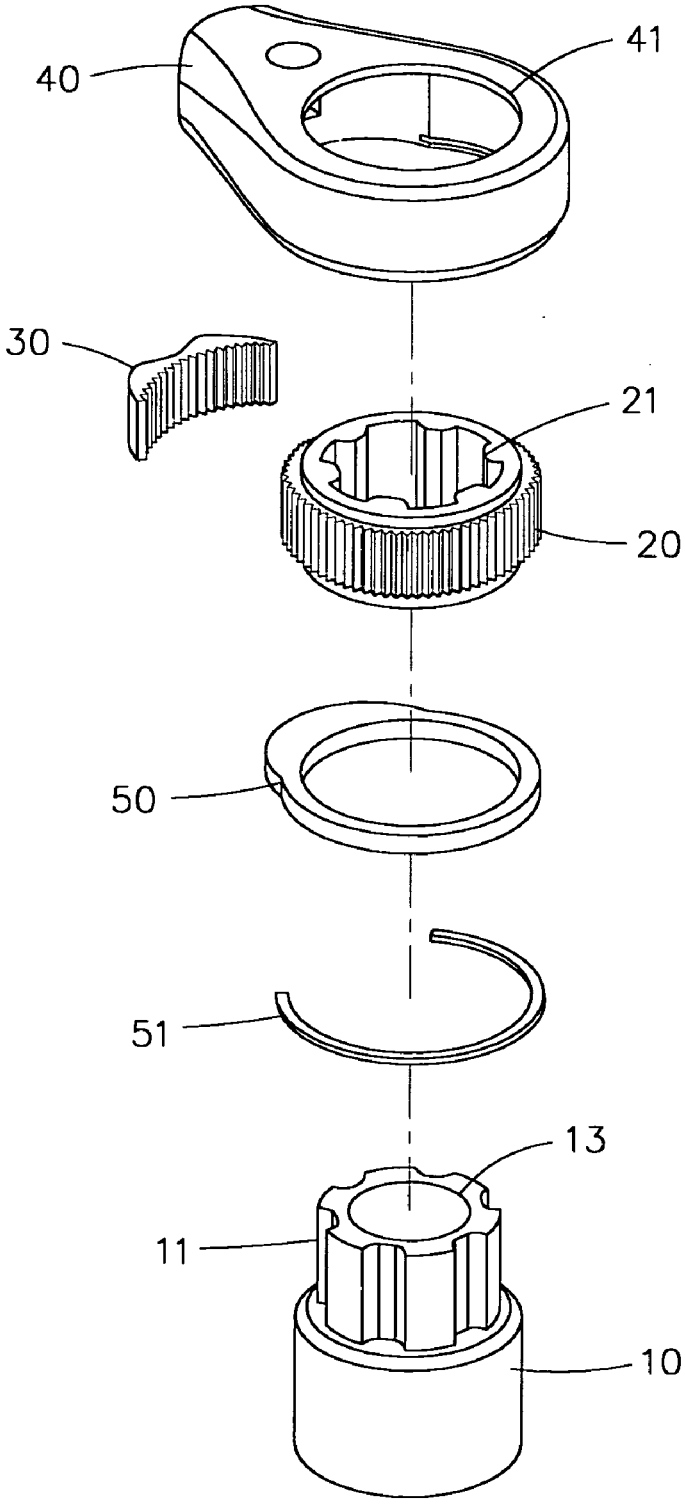
FIG. 3 is an exploded perspective view of the socket and a ratchet wrench in accordance with the preferred embodiment of the present invention.

Referring to FIG. 3, the socket body 10 of the socket co-operates with a ratchet wrench comprising a wrench body 40 having an end formed with a receiving hole 41, a ratchet wheel 20 mounted in the receiving hole 41 of the wrench body 40 by a cover 50 and a C-shaped snap ring 51 and having an inner wall formed with a plurality of insertion ribs 21 each inserted into a respective one of the insertion recesses 11 of the socket body 10 of the socket, and a pawl member 30 pivotally mounted in the receiving hole 41 of the wrench body 40 and engaged with the ratchet wheel 20. Preferably, each of the insertion ribs 21 of the ratchet wheel 20 has a shape matching that of a respective one of the insertion recesses 11 of the socket body 10 of the socket.

Figure 4:
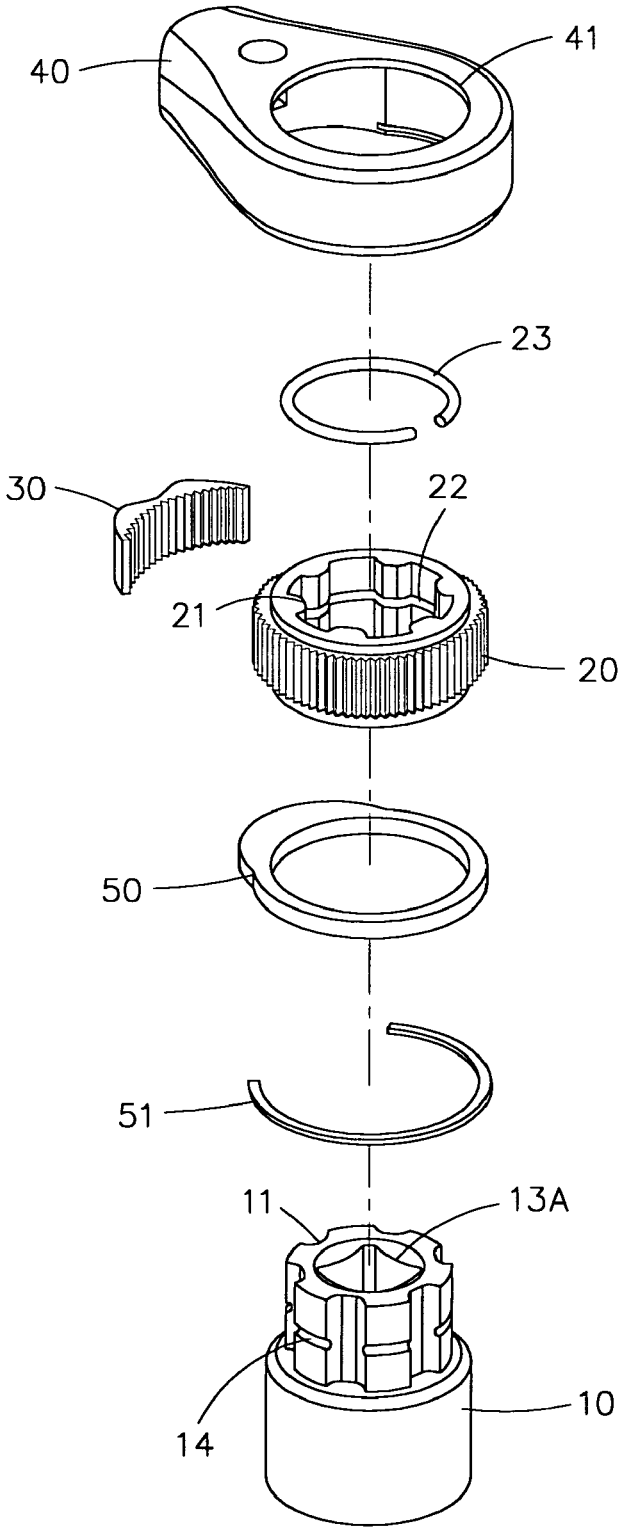
FIG. 4 is an exploded perspective view of the socket and a ratchet wrench in accordance with another embodiment of the present invention.

Referring to FIG. 4, the socket body 10 of the socket has an outer wall formed with a locking groove 14, the inner wall of the ratchet wheel 20 of the ratchet wrench is formed with a locking groove 22, and the ratchet wrench further comprises a C-shaped locking ring 23 mounted between the locking groove 14 of the socket body 10 of the socket and the locking groove 22 of the ratchet wheel 20 of the ratchet wrench. In addition, the mounting hole 13A of the socket body 10 of the socket has a square shape.

Figure 5:
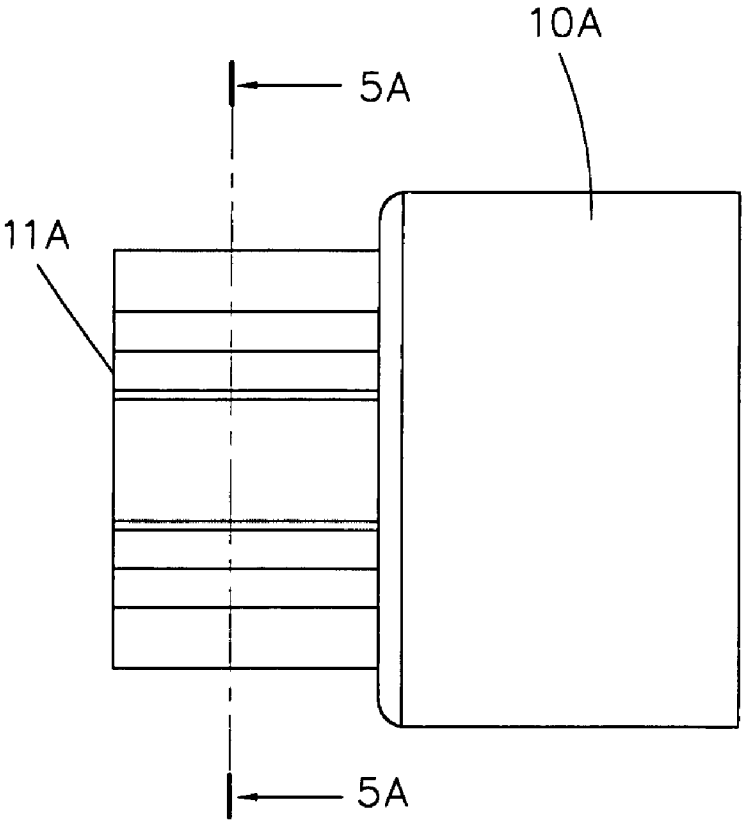
FIG. 5 is a plan view of a socket in accordance with another embodiment of the present invention.
Figure 5A:
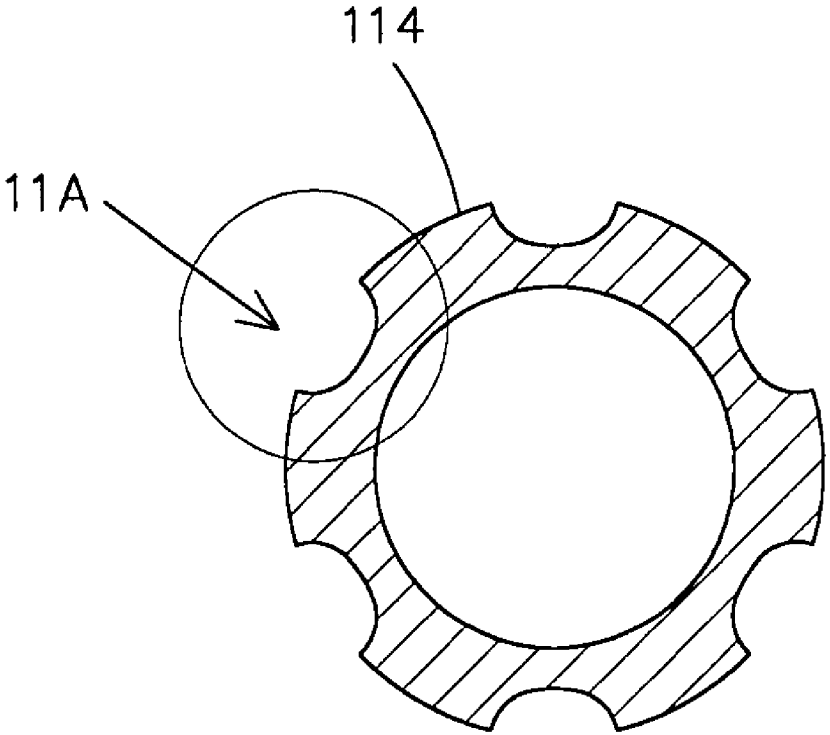
FIG. 5A is a plan cross-sectional view of the socket taken along line 5A—5A as shown in FIG. 5.
Figure 5B:
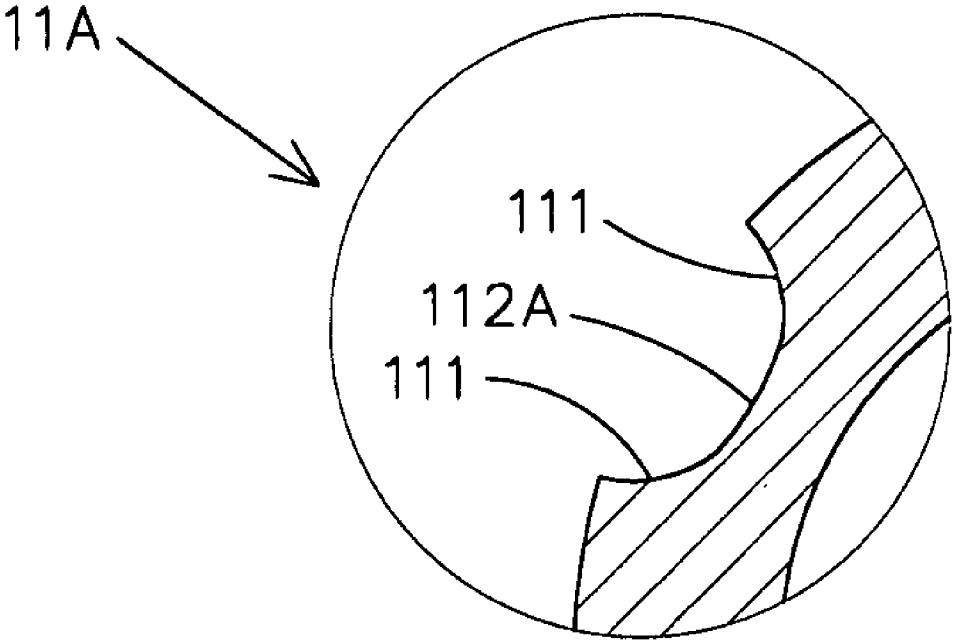
FIG. 5B is a partially enlarged view of the socket as shown in FIG. 5A.

Referring to FIGS. 5, 5A and 5B, the second urging face 112A of each of the insertion recesses 11A of the socket body 10A of the socket has a concave arc-shape.

Figure 6:
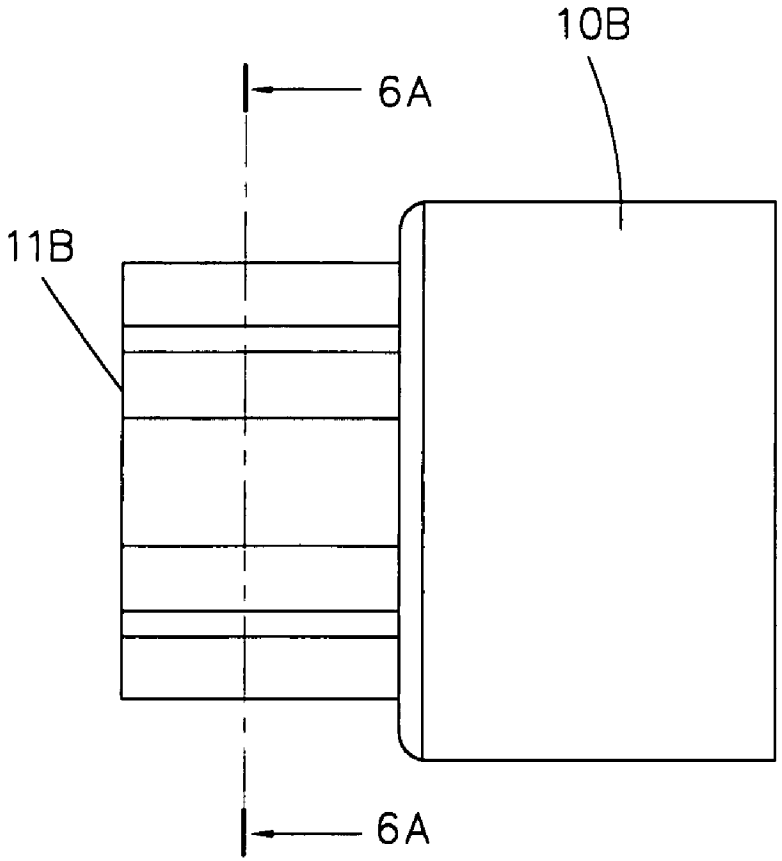
FIG. 6 is a plan view of a socket in accordance with another embodiment of the present invention.
Figure 6A:
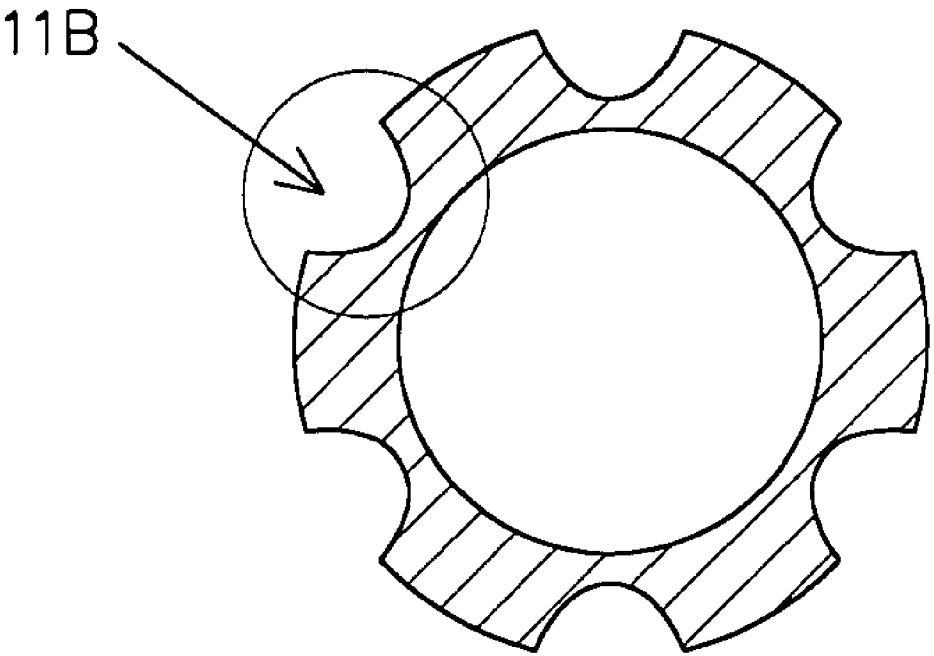
FIG. 6A is a plan cross-sectional view of the socket taken along line 6A—6A as shown in FIG. 6.
Figure 6B:
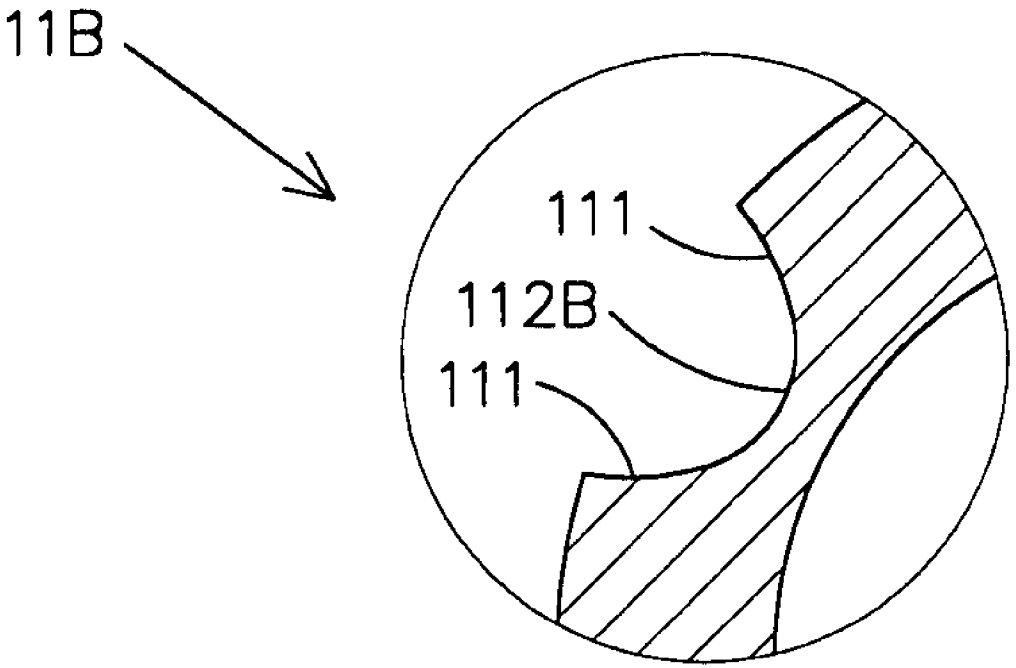
FIG. 6B is a partially enlarged view of the socket as shown in FIG. 6A.

Referring to FIGS. 6, 6A and 6B, the second urging face 112B of each of the insertion recesses 11B of the socket body 10B of the socket has a concave arc-shape with a smaller diameter.

Figure 7:
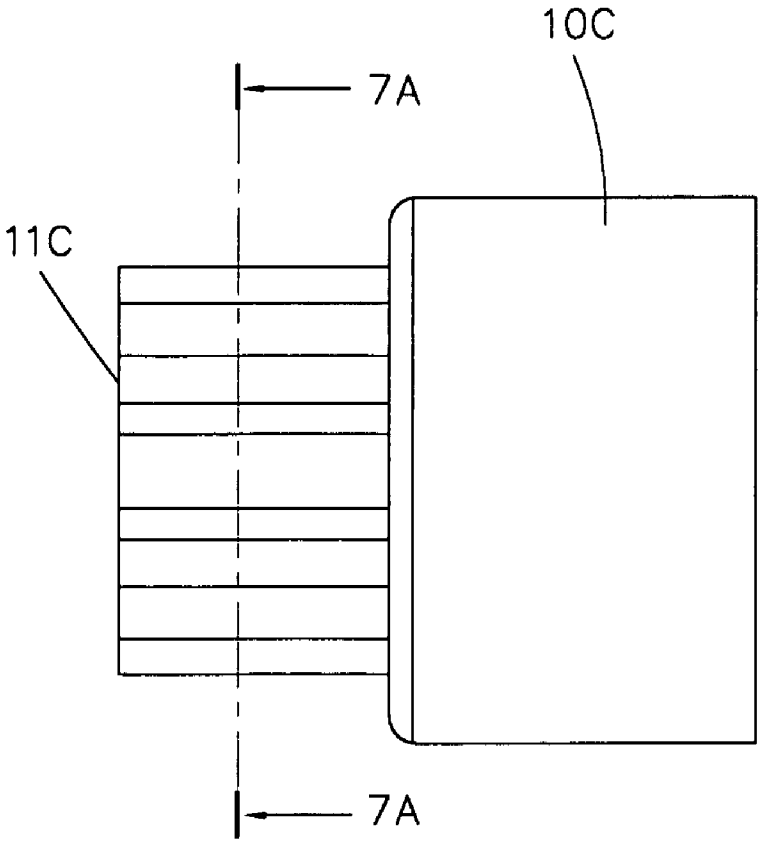
FIG. 7 is a plan view of a socket in accordance with another embodiment of the present invention.
Figure 7A:
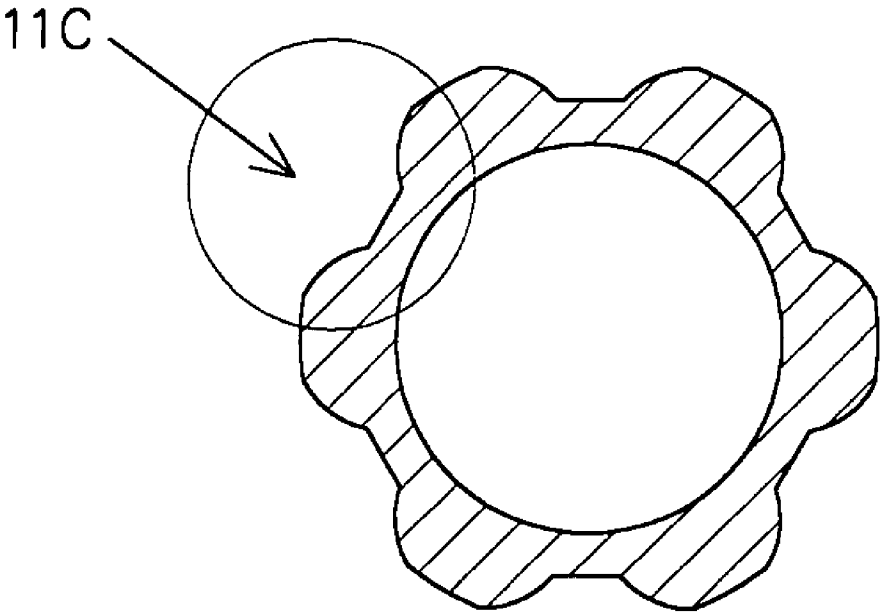
FIG. 7A is a plan cross-sectional view of the socket taken along line 7A—7A as shown in FIG. 7.
Figure 7B:
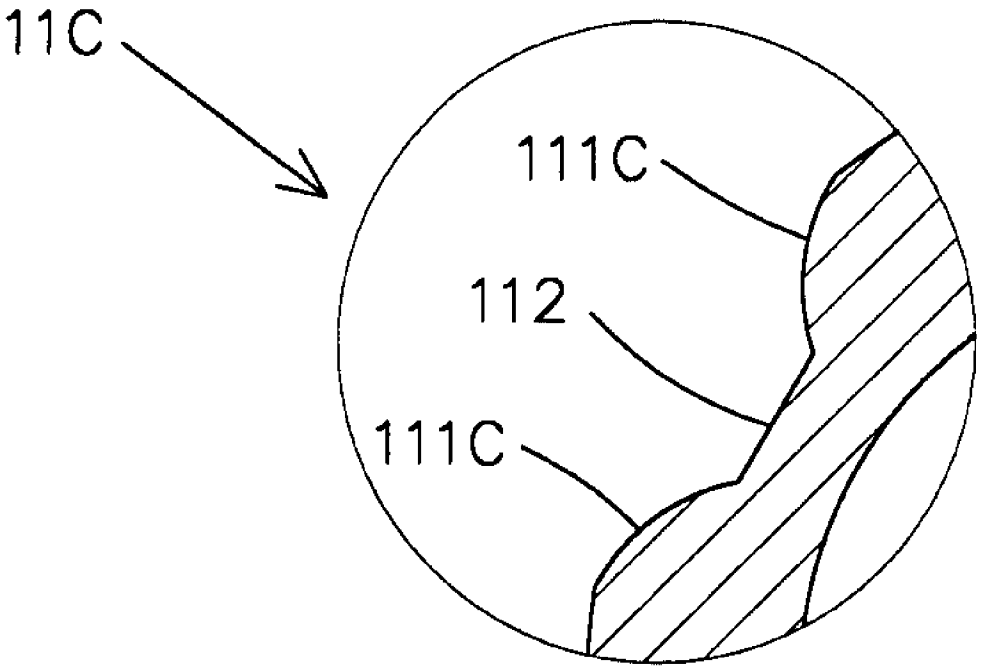
FIG. 7B is a partially enlarged view of the socket as shown in FIG. 7A.

Referring to FIGS. 7, 7A and 7B, the first urging face 111C of each of the insertion recesses 11C of the socket body 10C of the socket has a convex arc-shape.

Figure 8:
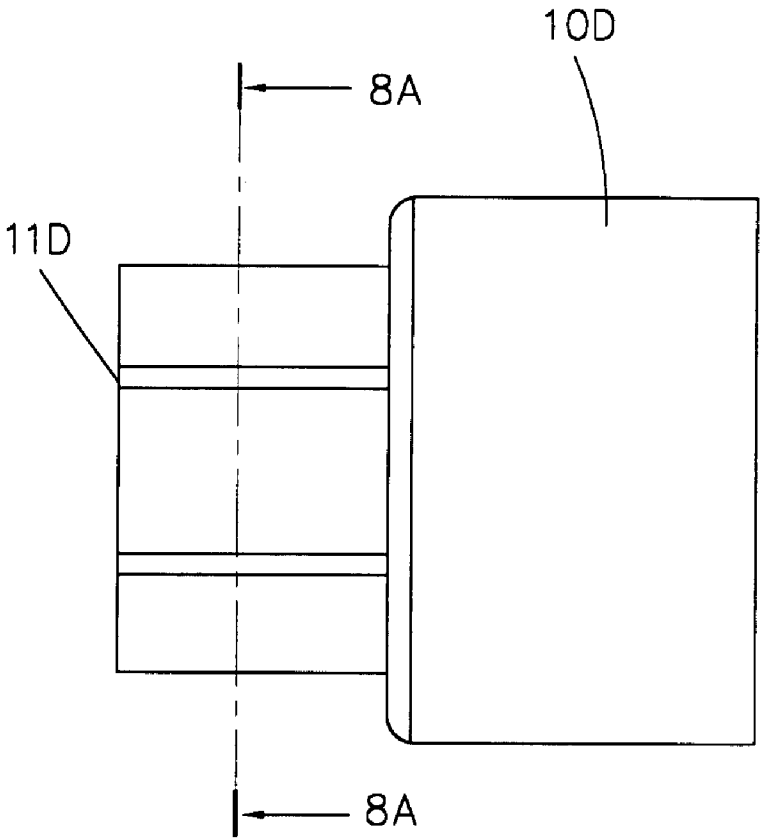
FIG. 8 is a plan view of a socket in accordance with another embodiment of the present invention.
Figure 8A:
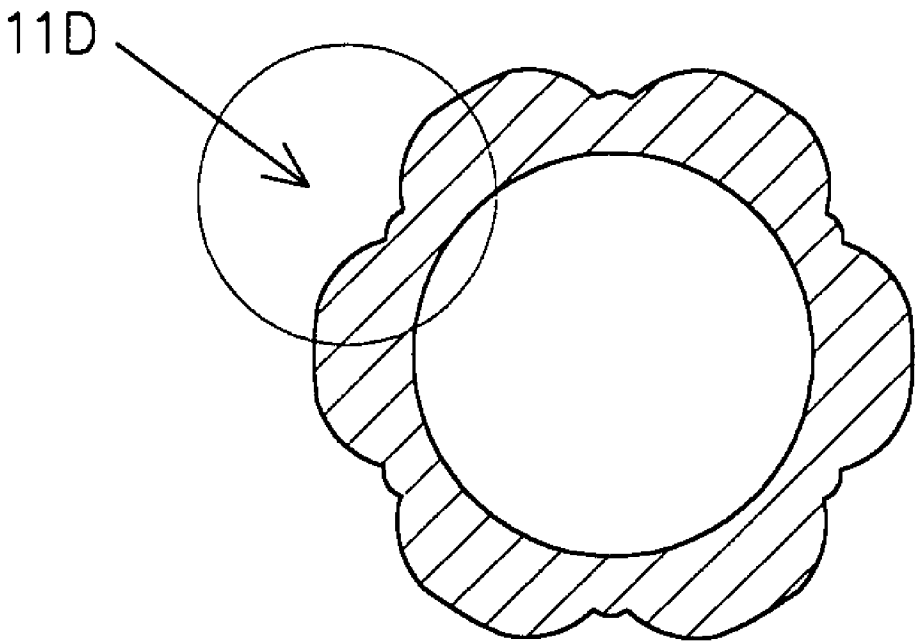
FIG. 8A is a plan cross-sectional view of the socket taken along line 8A—8A as shown in FIG. 8.
Figure 8B:
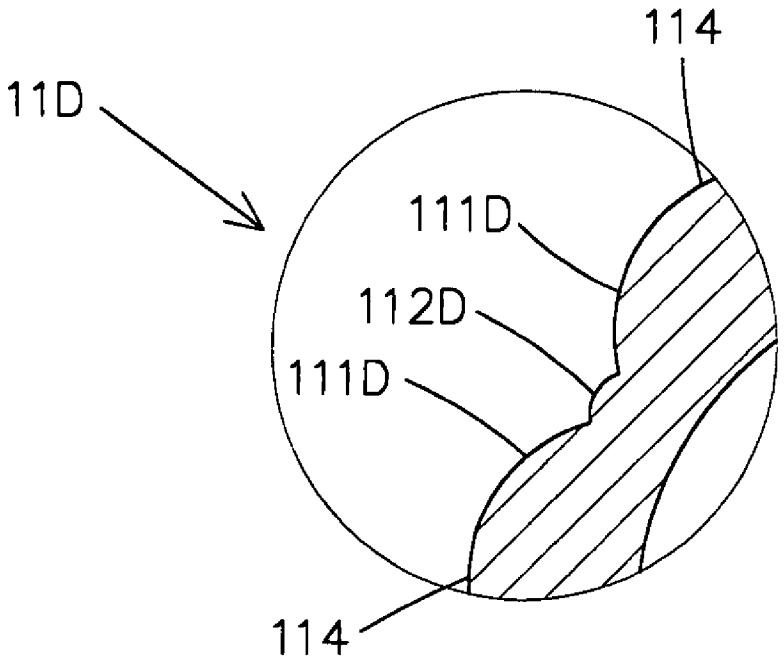
FIG. 8B is a partially enlarged view of the socket as shown in FIG. 8A.

Referring to FIGS. 8, 8A and 8B, the first urging face 111D of each of the insertion recesses 11D of the socket body 10D of the socket has a convex arc-shape, and the second urging face 112D of each of the insertion recesses 11D of the socket body 10D of the socket has a convex arc-shape. In addition, the first urging face 111D of each of the insertion recesses 11D of the socket body 10D of the socket is tangent to the respective arc-shaped protruding faces 114.

Figure 9:
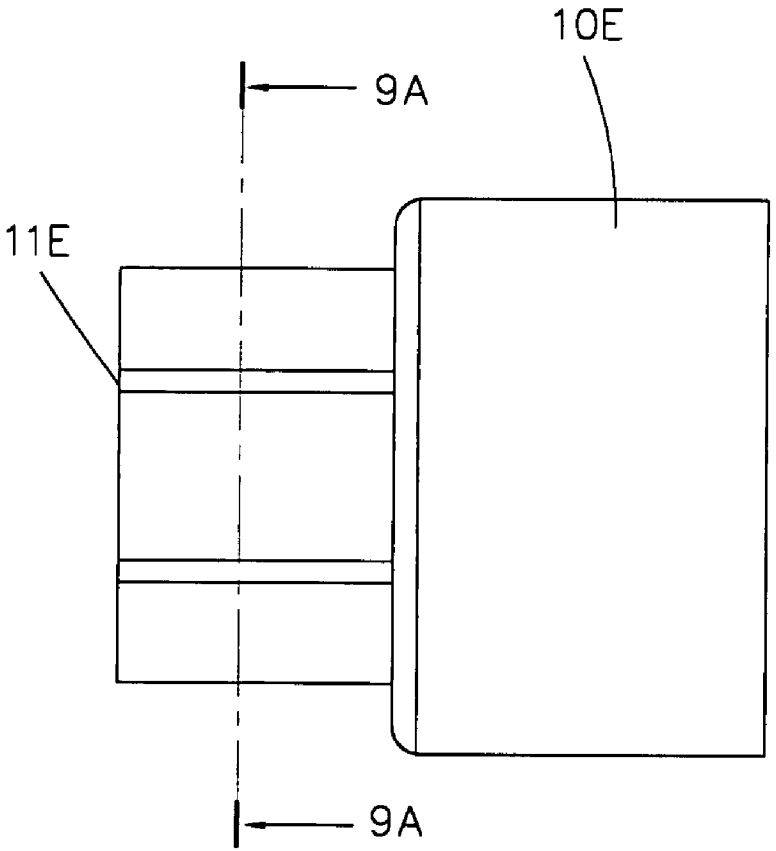
FIG. 9 is a plan view of a socket in accordance with another embodiment of the present invention.
Figure 9A:
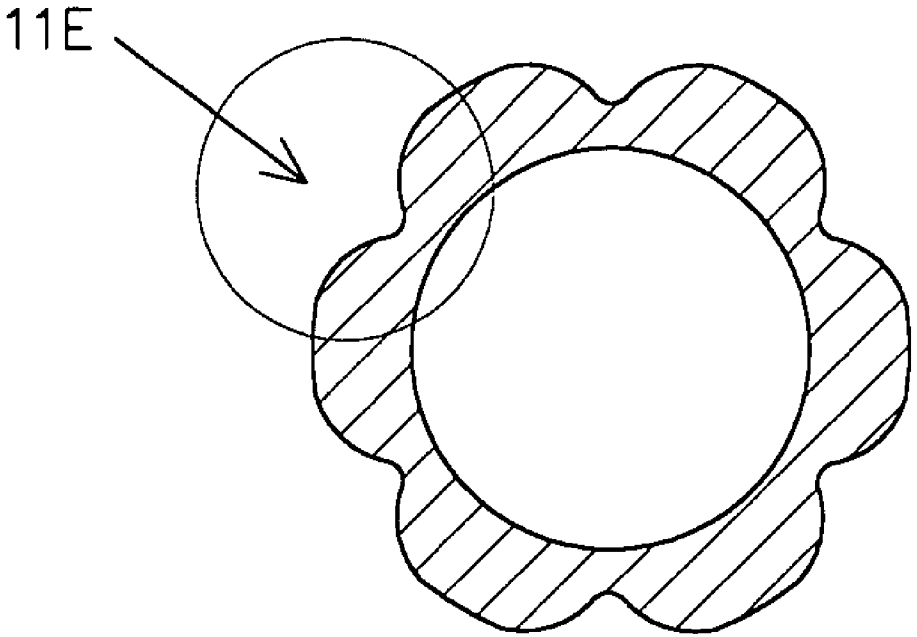
FIG. 9A is a plan cross-sectional view of the socket taken along line 9A—9A as shown in FIG. 9.
Figure 9B:
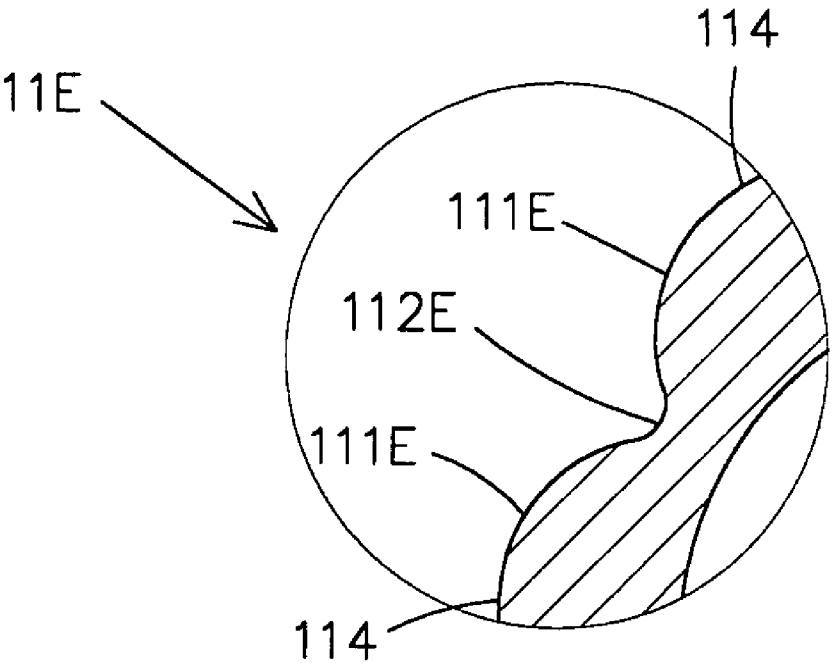
FIG. 9B is a partially enlarged view of the socket as shown in FIG. 9.

Referring to FIGS. 9, 9A and 9B, the first urging face 111E of each of the insertion recesses 11E of the socket body 10E of the socket has a convex arc-shape, and the second urging face 112E of each of the insertion recesses 11E of the socket body 10E of the socket has a concave arc-shape. In addition, an intersection of the first urging face 111E and the second urging face 112E of each of the insertion recesses 11E of the socket body 10E of the socket has a chamfered shape to enhance the structural strength of the socket.

Accordingly, each of the insertion recesses of the socket body of the socket has two opposite sides each formed with a first urging face and a mediate portion formed with a second urging face located between the first urging faces, so that the socket body of the socket has a greater structural strength, thereby preventing the socket from being broken or worn out due to an excessive torque during operation of the socket.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket, comprising a socket body having an outer wall formed with a plurality of insertion recesses each having two opposite sides each formed with a first urging face and a mediate portion formed with a second urging face located between the first urging faces of the two opposite sides; wherein the first urging face of each of the insertion recesses of the socket body has a convex arc-shape;

the second urging face of each of the insertion recesses has a flat shape.

2. The socket in accordance with claim 1, wherein the outer wall of the socket body is formed with a plurality of arc-shaped protruding faces located between the insertion recesses.

3. The socket in accordance with claim 1, further comprising a ratchet wrench co-operating with the socket body of the socket and comprising a wrench body having an end formed with a receiving hole, a ratchet wheel mounted in the receiving hole of the wrench body and having an inner wall formed with a plurality of insertion ribs each inserted into a respective one of the insertion recesses of the socket body of the socket.

4. The socket in accordance with claim 3, wherein each of the insertion ribs of the ratchet wheel has a shape matching that of a respective one of the insertion recesses of the socket body of the socket.

5. The socket in accordance with claim 3, wherein the socket body of the socket has an outer wall formed with a locking groove, the inner wall of the ratchet wheel of the ratchet wrench is formed with a locking groove, and the ratchet wrench further comprises a C-shaped locking ring mounted between the locking groove of the socket body of the socket and the locking groove of the ratchet wheel of the ratchet wrench.

6. The socket in accordance with claim 1, wherein the outer wall of the socket body is formed with a plurality of arc-shaped protruding faces located between the insertion recesses, and the first urging face of each of the insertion recesses of the socket body has a distal end tangent to the respective arc-shaped protruding face.

7. A socket, comprising a socket body having an outer wall formed with a plurality of insertion recesses each having two opposite sides each formed with a first urging face and a mediate portion formed with a second urging face located between the first urging faces of the two opposite sides, wherein the first urging face of each of the insertion recesses of the socket body has a convex arc-shape;

the second urging face of each of the insertion recesses of the socket body has a convex arc-shape.

8. A socket, comprising a socket body having an outer wall formed with a plurality of insertion recesses each having two opposite sides each formed with a first urging face and a mediate portion formed with a second urging face located between the first urging faces of the two opposite sides, wherein the first urging face of each of the insertion recesses of the socket body has a convex arc-shape, the second urging face of each of the insertion recesses of the socket body has a concave arc-shape, and an intersection of the first urging face and the second urging face of each of the insertion recesses of the socket body has a chamfered shape.

9. The socket in accordance with claim 1, wherein the socket body has an inside formed with a circular mounting hole.

10. The socket in accordance with claim 1, wherein the socket body has an inside formed with a square mounting hole.

* * * * *